US007886515B2

(12) United States Patent
Indiano

(10) Patent No.: US 7,886,515 B2
(45) Date of Patent: Feb. 15, 2011

(54) PROCESS FOR MANUFACTURING YARN MADE FROM A BLEND OF FIBERS OF COTTON, NYLON AND SILVER

(75) Inventor: I. Michael Indiano, Yardley, PA (US)

(73) Assignee: AG Technologies, Inc., Watchung, NJ (US)

( * ) Notice: Subject to any disclaimer, the term of this patent is extended or adjusted under 35 U.S.C. 154(b) by 33 days.

(21) Appl. No.: 12/459,066

(22) Filed: Jun. 26, 2009

(65) Prior Publication Data

US 2010/0000196 A1 Jan. 7, 2010

Related U.S. Application Data

(60) Provisional application No. 61/133,763, filed on Jul. 2, 2008.

(51) Int. Cl.
*D02G 3/02* (2006.01)

(52) U.S. Cl. ..... 57/255; 57/295

(58) Field of Classification Search ..... 57/255, 57/257, 258, 295; 428/359, 361; 19/145.5, 19/145.7

See application file for complete search history.

(56) References Cited

U.S. PATENT DOCUMENTS

| | | | | |
|---|---|---|---|---|
| 2,245,359 | A | | 6/1941 | Perry |
| 3,251,178 | A | | 5/1966 | Stirling |
| 3,347,727 | A | | 10/1967 | Bobkowicz et al. |
| 3,998,988 | A | | 12/1976 | Shimomai et al. |
| 4,017,942 | A | | 4/1977 | Clayton et al. |
| 4,042,737 | A | | 8/1977 | Forsgren et al. |
| 4,388,370 | A | | 6/1983 | Ellis et al. |
| 4,756,941 | A | | 7/1988 | McCullough et al. |
| 4,793,130 | A | * | 12/1988 | Togashi et al. ..... 57/210 |
| 5,201,169 | A | * | 4/1993 | Miyashita ..... 57/7 |
| 5,234,720 | A | | 8/1993 | Neal et al. |
| 5,372,739 | A | | 12/1994 | Neal et al. |
| 5,549,957 | A | | 8/1996 | Negola et al. |
| 5,677,058 | A | | 10/1997 | Neal et al. |
| 6,032,450 | A | * | 3/2000 | Blum ..... 57/75 |
| 6,035,493 | A | | 3/2000 | Carlton |
| 6,723,428 | B1 | | 4/2004 | Foss et al. |
| 6,815,060 | B2 | | 11/2004 | Yuuki |
| 6,946,196 | B2 | | 9/2005 | Foss |
| 7,069,714 | B2 | * | 7/2006 | De Boni ..... 57/210 |
| 7,144,830 | B2 | * | 12/2006 | Hill et al. ..... 442/205 |
| 7,592,276 | B2 | * | 9/2009 | Hill et al. ..... 442/301 |
| 2008/0209688 | A1 | * | 9/2008 | Palmer et al. ..... 19/145.5 |

* cited by examiner

*Primary Examiner*—Shaun R Hurley
(74) *Attorney, Agent, or Firm*—Sperry, Zoda & Kane

(57) ABSTRACT

The present invention provides a novel process for making yarn from a unique combination of fibers of cotton, nylon (preferably nylon6) and silver and a process for forming this yarn utilizing a unique sequencing of individual steps. The final yarn product is extremely strong, stable and useful for being woven into various fabrics and/or materials and, most particularly, possesses enhanced antimicrobial properties.

18 Claims, No Drawings

PROCESS FOR MANUFACTURING YARN MADE FROM A BLEND OF FIBERS OF COTTON, NYLON AND SILVER

The present utility application hereby formally claims priority of U.S. Provisional Patent application No. 61/133,763 filed Jul. 2, 2008 on "Yarn Made From A Blend Of Cotton, Nylon And Silver And Process For Manufacturing Thereof" filed by the same inventor listed herein, namely, I. Michael Indiano, and said referenced provisional application is hereby formally incorporated by reference as an integral part of the present application.

BACKGROUND OF THE INVENTION

1. Field of the Invention

The present invention deals with the field of yarns made from various component materials usually fibrous materials and a novel process for making this yarn is such a manner that it is stable to facilitate weaving and has unique antimicrobial characteristics. The yarns made according to the present invention can be utilized for various purposes such as forming woven fabrics and other materials and can be formed with various characteristics depending upon the various fibers utilized in the process for making of the yarn. The yarn and process for making yarn of the present invention is particularly useful for making fabric and material which is capable of destroying or inhibiting the growth of various types of undesirable microorganisms.

2. Description of the Prior Art

Various yarn compositions and processes for making yarns and carding machines used in the process for making yarns have been patented such as shown in U.S. Pat. No. 2,245,359 patented Jun. 10, 1941 to C. G. Perry on "Yarn Making"; and U.S. Pat. No. 3,251,178 patented May 17, 1966 to J. Stirling on an "Apparatus For Making Rope Strand Or Yarn"; and U.S. Pat. No. 3,347,727 patented to E. Bobkowicz et al on Oct. 17, 1967 and assigned to Emilian Bobkowicz; and U.S. Pat. No. 3,998,988 patented Dec. 21, 1976 to A. Shimomai et al and assigned to Teijin Limited on a "Conjugate Fiber, Fibrous Material And Fibrous Article Made Therefrom And Process For Production Thereof"; and U.S. Pat. No. 4,017,942 patented Apr. 19, 1977 to M. Clayton et al and assigned to The English Card Clothing Company on a "Textile Carding"; and U.S. Pat. No. 4,042,737 patented Aug. 16, 1977 to K. F. Forsgren et al and assigned to Rohm and Haas Company on a "Process For Producing Crimped Metal-Coated Filamentary Materials, And Yarns And Fabrics Obtained Therefrom"; and U.S. Pat. No. 4,388,370 patented Jun. 14, 1983 to V. S. Ellis et al and assigned to Imperial Chemical Industries Limited on "Electrically-Conductive Fibres"; and U.S. Pat. No. 4,756,941 patented Jul. 12, 1988 to F. P. McCullough et al and assigned to The Dow Chemical Company on a "Method And Materials For Manufacture Of Anti-Static Carpet And Backing"; and U.S. Pat. No. 5,234,720 patented Aug. 10, 1993 to R. D. Neal et al and assigned to Eastman Kodak Company on a "Process Of Preparing Lubricant-Impregnated Fibers"; and U.S. Pat. No. 5,372,739 was patented Dec. 13, 1994 to R. D. Neal et al and assigned to Eastman Chemical Company on a "Lubricant-Impregnated Fibers, Lubricant, And Processes For Preparation Thereof"; and U.S. Pat. No. 5,549,957 patented Aug. 27, 1996 to E. J. Negola et al on a "Bulked Continuous Filament carpet Yarn"; and U.S. Pat. No. 5,677,058 patented Oct. 14, 1997 to R. D. Neal et al and assigned to Eastman Chemical Company on a "Lubricant Impregnated Fibers And Processes For Preparation Thereof"; and U.S. Pat. No. 6,035,493 patented Mar. 14, 2000 to W. C. Carlton on a "Textile Carding And Relevant Apparatus"; and U.S. Pat. No. 6,723,428 patented Apr. 20, 2004 to S. W. Foss et al and assigned to Foss Manufacturing Co., Inc. on "Anti-Microbial Fiber And Fibrous Products"; and U.S. Pat. No. 6,815,060 patented Nov. 9, 2004 to Y. Yuuki and assigned to Asahi Kasei Kabushiki Kaisha on "Spun Yarn"; and U.S. Pat. No. 6,841,244 patented Jan. 11, 2005 to S. W. Foss et al and assigned to Foss Manufacturing Co., Inc. on "Anti-Microbial Fiber And Fibrous Products"; and U.S. Pat. No. 6,946,196 patented Sep. 20, 2005 to S. W. Foss and assigned to Foss Manufacturing Co., Inc. on "Anti-Microbial Fiber And Fibrous Products".

SUMMARY OF THE INVENTION

Most generally the present invention utilizes cotton, nylon and silver fibers which are physically mixed together in a large container and then sprayed with a liquid ceramic which forms a physical mixture of the component fibers within the liquid ceramic material.

This material is removed from the container or vat in batches each normally being approximately 20 to 100 pounds per batch of material. These batches of this coated fibrous mixture are then placed in a uniquely configured carding machine which has very large teeth for gently and slowly opening of the fibers of the cotton, nylon6 and silver such that a completely homogeneous mixture of these three components and the liquid ceramic spray can be achieved. This mixing into a completely homogeneous blend of opened fibers of the various components can take as many as seven individual carding steps in the carding process and can take as long as a period of three hours.

The carding machine itself utilizes a uniquely configured card, sold commercially under the trade name "Wolf card" utilizes unusually large teeth to prevent damaging of the individual component fibers and, in particular, prevent damaging of the silver fibers while at the same time achieving a fully opened and blended homogeneous final mixture of all the component fibers.

This fully opened and blended fiber is then spun into yarn using a sequence of individual steps. The finally formed yarn is then coated with a paraffin and ceramic wax mixture. The paraffin component of the mixture lubricates the spinning yarn to allow it to be easily used to make fabrics or other materials and also facilitates winding of this final yarn onto cones. The ceramic component of this coating is applied for sealing and encapsulating the finally formed yarn. After heating this ceramic material chemically and molecularly bonds the yarn together by encapsulating thereof in order to maintain the overall integrity of the structure of the yarn. This chemical and mechanical bonding is enhanced by the subsequent heating of the finally formed yarn to a temperature of approximately 180 degrees in a heating chamber which slightly melts the nylon and also stabilizes the yarn by chemically and mechanically bonding the ceramic material for the purpose of encapsulating the yarn.

It is an object of the present invention to provide a yarn made from a homogeneous blend of cotton, nylon and silver fibers.

It is an object of the present invention to provide a yarn made from a unique combination of cotton, Nylon6 and silver by a unique process not known heretofore.

It is an object of the present invention to provide a blend of individual fibers of cotton, nylon and silver having a limited length normally between 30 and 60 millimeters individually.

It is an object of the present invention to provide a yarn made from a blend of cotton, nylon6 and silver fibers as well as a process for manufacturing thereof wherein the finally formed yarn is substantially capable of destroying or inhibiting the growth of microorganisms.

It is an object of the present invention to provide a unique process for making a uniquely formed yarn made from a novel carding machine utilizing a Wolf card with oversized teeth which allows for a slow gentle processing of the fiber mixture for opening and blending of the individual component fibers to facilitate forming of a finally blended material which is completely homogeneous while at the same time preventing damage to any silver component or other fibrous component thereof while also preventing the silver from agglomerating.

It is an object of the present invention to provide a yarn made from a blend of cotton, nylon and silver as well as a process for manufacture thereof wherein a paraffin and ceramic wax mixture is applied to the finally formed yarn to facilitate lubrication thereof and for encapsulating thereof to maintain integrity of the structure of the resultant yarn.

It is an object of the present invention to provide a yarn made from a blend of cotton, Nylon6 and silver and a process for manufacturing thereof wherein the finally formed yarn is steam heated within the heating chamber to a temperature of as high as 180 degrees Fahrenheit to slightly melt the nylon and to stabilize the yarn structure by chemically and mechanically bonding it within the ceramic material which has been applied to the yarn and encapsulates the yarn.

DETAILED DESCRIPTION OF THE PREFERRED EMBODIMENT

The present invention provides a unique composition for a yarn made from a blend of cotton, silver and nylon, preferably Nylon 6 material, as well as a novel sequence of process steps for the manufacturing thereof. This preferred embodiment described herein is only a single example of the unique construction for yarn combining this above-described blend. This disclosure illustrate only a example of a novel type of processing that can be utilized for the manufacturing of such yarn. It should be appreciate that other similar steps can be included in other similar methods and still come within the general overall contemplated concept of the present disclosure herein for the method of produce yarn shown herein as well as for the composition of the yarn so produced.

Usually the blend from which the yarn is made will include cotton and nylon fibers which are purchased in lengths of approximately 30 to 60 millimeters in length. This specific length is preferred but other lengths somewhat outside of the range defined above will also provide usable. Silver is then purchased in longer fiber lengths which are then cut to be complementary to the length chosen for the cotton and Nylon6 fibers. As such, normally the various fibers used for forming yarn in this invention will include fibers all of approximately the same length, but this requirement can vary significantly depending upon the application and use for the finally formed yarn.

In the preferred configuration the cotton fibers, otherwise known collectively as cotton staple, will comprise approximately 65% of the initial mixture of fibers used to ultimately form the yarn. The Nylon fibers will preferably be chosen as Nylon6 fibers due to the better characteristics thereof, particularly the lower melting point when compared to other available Nylon materials. These fiber of Nylon6 is usually referenced as Nylon6 staple and will comprise approximately 30% of the initial yarn mixture. This silver staple component will then be added to an extent such as to comprise approximately 5% of the fiber mixture. Therefore the overall ratio of cotton staple to Nylon6 staple to silver staple in the initial mixture of fibrous components will be 65% to 30% to 5%, respectively.

Of the various Nylon fibers available for use in the present invention, Nylon6 has been chosen as preferable for the Nylon fiber yarn component because it has a lower melting point and since a slight melting of the nylon will occur during the final heating step of the present yarn making process when the component fibers are encapsulated with a ceramic fixing material. For this reason Nylon6 is the preferred material for the Nylon component of the composition of the yarn of the present invention.

The proper proportion of cotton staple, Nylon6 staple and silver staple are initially physically placed within a container or large vat and are mixed. This physical mixing can take place manually utilizing a manual tool such as a large wooden spatula or can use any other system for physically mixing the fiber components together initially. It should be appreciate that such physical mixing of the fibers has physical limitations due to the fibrous nature of the components and thus only a moderately thorough physical mixture can be achieved at this time. Once a moderate mixing of the fibrous components within the vat has been completed, the entire content of the vat is then sprayed with a clear translucent liquid ceramic material. This material is quite similar to a paint without a pigment since it is clear and translucent. This liquid ceramic spraying step coats all of the mixture of the fibrous materials throughout the container or vat. These fibrous materials which are now coated with the clear translucent liquid ceramic spray will then physically be mixed again in a similar manner as performed previously in order to further mix both the fibers with the liquid ceramic material sprayed into the vat.

The next step in this process is to initiate the blending of this fiber mixture by opening of the fibers. Individual batches of any size but preferably 20 pounds to 100 pound of the fiber mixture are removed from the vat and placed into the blending chamber of a carding machine. The carding machine for the present invention, preferably, is a Wolf carding machine which uses a type of card having special coarse teeth for the purpose of very gently and slowly opening and blending the mixture of different fibers. This type of carding machine is utilized specifically to open the fibers such that they can be homogeneously blended together. This opening and homogeneous blending occurs very slowly with the use of such a coarse card in the carding machine and, thus, requires a longer period of time with a number of individual passes of the batches of fibrous material used for effectively opening and blending the mixture. As many as seven individual carding steps may be required over as long as a three hour period to achieve full and complete homogeneous opening and blending of the fibrous mixture due to the fact that a card is being used for this carding process utilizes very coarse or open teeth as opposed to a fine toothed card which is utilized for other processes and achieves mixing and blending faster. In the present invention it is important to appreciate that such a fine toothed card not be utilized because such a card will lead to clogging or agglomerating of the silver fibers together which would prevent the thorough mixing thereof homogeneously throughout the overall fibrous mixture.

The Wolf carding machine described in this invention is commonly used for carding other materials such as wool. By modifying the configuration of the teeth to be more coarse, it can be used to provide a slower carding process as needed for the present combination of cotton staple, Nylon6 staple and silver staple. Once the carding of the needed amount of the mixture in the vat is finalized, then all the fibers will be opened and the final mixture will be completely homogeneous. It is then possible to spin the blended fiber into yarn by a process of sequential steps.

Initially the blended homogeneous fiber material is formed into a sliver form which is somewhat tighter than the initial final carded mixture. It is then made further tighter by placing it into a roving form. This roving is then wound onto roving spools or bobbins and it moves into a spinning frame to facilitate spinning directly into the final yarn form. The final spinning form takes the blended fiber which has been formed into sliver and spins it into yarn.

At this stage the yarn needs to be lubricated to facilitate use weaving and further processing thereof in forming of fabrics and material and to facilitate winding thereof onto cones. For this purpose a paraffin and ceramic wax mixture is applied onto the spinning yarn as it is wound onto the cones. The paraffin component of the wax mixture lubricates the yarn to allow it to be more easily knitted for being formed into woven materials and facilitates the direct placement on the cones themselves. The ceramic component, however, is utilized for seal the yarn for by encapsulating thereof and for maintaining the basic structure of the yarn.

The so formed yarn is then steam heated within a heating chamber at a temperature of approximately 180 degrees Fahrenheit which slightly melts the nylon6 to stabilize the yarn and also molecularly bonds the ceramic material which is positioned encapsulating the yarn which chemically retains and further bonds the nylon fibers, the cotton fibers and especially the silver fibers within the yarn to stabilize the final yarn product. As such, the final yarn product is stabilized by the ceramic component of the final coating and is lubricated by the paraffin component of the final coating and in this manner provides an anti-microbial capability not known or available heretofore.

While particular embodiments of this invention have been described above, it will be apparent that many changes may be made in the form, arrangement, sequencing and positioning of the various elements of the combination of element subject to this patent application. In consideration thereof, it should be understood that preferred embodiments of this invention disclosed herein are intended to be illustrative only and not intended to limit the scope of the invention.

I claim:

1. A process for making yarn having enhanced strength, stability and antimicrobial properties comprising:

A. providing a cotton staple of cotton fibers all having a uniform fiber length of between 30 mm and 60 mm approximately;

B. providing a nylon staple of nylon fibers all having a uniform fiber length of between 30 mm and 60 mm approximately;

C. providing a silver staple of silver fibers;

D. cutting the silver fibers of the silver staple to a uniform fiber length of between 30 mm and 60 mm approximately;

E. forming a fibrous staple compound containing approximately 65% cotton fibers and approximately 30% nylon fiber and approximately 5% silver fiber as measured by weight;

F. primary mixing of the fibrous staple compound;

G. coating of the fibrous staple compound with a liquid ceramic material;

H. secondary mixing of the fibrous staple compound;

I. dividing of the fibrous staple compound into individual batches of fibrous staple compound;

J. blending of each of the individual batches of fibrous staple compound in order to further open the fibrous material located therewithin for facilitating more homogenous mixing of the individual fibrous components of the fibrous staple compound; and K. spinning the blended fibrous staple compound for tightening thereof into sliver form of the fibrous staple compound;

L. tightening of the sliver form of the fibrous staple compound into a roving form of the fibrous staple compound;

M. placing of the roving form of the fibrous staple compound onto roving spools;

N. spinning of the roving form of the fibrous compound into yarn;

O. winding of the yarn onto cones while applying of a mixture of paraffin and ceramic wax thereon for lubrication thereof and to facilitate stabilizing thereof; and P. heating of the yarn sufficiently to cause melting of the nylon component thereof in order for enhancing stabilization of the yarn and to molecularly bond the ceramic material thereto for chemically retaining and further bonding together of the various fibers contained within the yarn.

2. The process for making yarn having enhanced strength, stability and antimicrobial properties as defining in claim 1 wherein said nylon fibers comprises fibers of nylon 6 material.

3. The process for making yarn having enhanced strength, stability and antimicrobial properties as defining in claim 1 wherein said mixing of the fibrous staple compound is performed by mechanical mixing thereof.

4. The process for making yarn having enhanced strength, stability and antimicrobial properties as defining in claim 3 wherein said mechanical mixing of the fibrous staple compound is performed by placing of the fiber mixture into a container and manually mixing thereof.

5. The process for making yarn having enhanced strength, stability and antimicrobial properties as defining in claim 1 wherein said coating of the fibrous staple compound with a liquid ceramic material is performed by applying of a translucent liquid ceramic material.

6. The process for making yarn having enhanced strength, stability and antimicrobial properties as defining in claim 1 wherein said coating of the fibrous staple compound with a liquid ceramic material is performed by spraying of a liquid ceramic material thereupon.

7. The process for making yarn having enhanced strength, stability and antimicrobial properties as defining in claim 1 wherein said secondary mixing of the fibrous staple compound is performed by secondary mechanical mixing thereof.

8. The process for making yarn having enhanced strength, stability and antimicrobial properties as defining in claim 7 wherein said secondary mechanical mixing of the fibrous staple compound is performed by placing of the fiber mixture into a container and manually mixing thereof.

9. The process for making yarn having enhanced strength, stability and antimicrobial properties as defining in claim 1 wherein said dividing of the fibrous staple compound into individual batches of fibrous staple compound is performed by providing individual batches of fibrous staple compound each having a weight of approximately 20 to 100 pounds.

10. The process for making yarn having enhanced strength, stability and antimicrobial properties as defining in claim 1 wherein said blending of the individual batches of fibrous staple compound in order to open the fibers located therewithin is performed in a textile carding machine.

11. The process for making yarn having enhanced strength, stability and antimicrobial properties as defining in claim 10 wherein said blending of each of the individual batches of fibrous staple compound in order to further open the fibrous material located therewithin for facilitating more homogenous mixing of the individual fibrous components of the fibrous staple compound is performed by passing each individual batch of fibrous staple compound through the textile carding machine a plurality of times.

12. The process for making yarn having enhanced strength, stability and antimicrobial properties as defining in claim 10 wherein said blending of individual batches of fibrous staple compound is performed in a textile carding machine configured utilizing a coarse textile card.

13. The process for making yarn having enhanced strength, stability and antimicrobial properties as defining in claim 1 wherein said blending of each of the individual batches of fibrous staple compound in order to further open the fibrous material located therewithin for facilitating more homogenous mixing of the individual fibrous components of the fibrous staple compound is performed by passing each individual batch of fibrous staple compound through the textile carding machine at least seven times.

14. The process for making yarn having enhanced strength, stability and antimicrobial properties as defining in claim 1 wherein placing of the roving form of the fibrous staple compound onto roving spools is performed by placing onto roving bobbins.

15. The process for making yarn having enhanced strength, stability and antimicrobial properties as defining in claim 1 wherein said spinning of the roving form of the fibrous compound into yarn is performed using a spinning frame.

16. The process for making yarn having enhanced strength, stability and antimicrobial properties as defining in claim 1 wherein said heating of the yarn is performed to approximately 180 degrees Fahrenheit.

17. The process for making yarn having enhanced strength, stability and antimicrobial properties as defining in claim 1 wherein said heating of the yarn is performed by steam heating thereof.

18. A process for making yarn having enhanced strength, stability and antimicrobial properties comprising:

A. providing a cotton staple of cotton fibers all having a uniform fiber length of between 30 mm and 60 mm approximately;

B. providing a nylon staple of nylon fibers all having a uniform fiber length of between 30 mm and 60 mm approximately wherein said nylon fibers are of nylon 6 material;

C. providing a silver staple of silver fibers;

D. cutting the silver fibers of the silver staple to a uniform fiber length of between 30 mm and 60 mm approximately;

E. forming a fibrous staple compound containing approximately 65% cotton fibers and 30% nylon fiber and 5% silver fiber as measured by weight;

F. primary mixing of the fibrous staple compound mechanically and manually;

G. coating of the fibrous staple compound with a liquid ceramic material wherein said coating of the fibrous staple compound with a liquid ceramic material is performed by spraying of a translucent liquid ceramic material thereupon;

H. secondary mixing of the fibrous staple compound mechanically and manually;

I. dividing of the fibrous staple compound into individual batches of fibrous staple compound each having a weight of approximately 20 pounds to 100 pounds;

J. blending of each of the individual batches of fibrous staple compound in a textile carding machine a plurality of separate times in order to further open the fibrous material located therewithin for facilitating more homogenous mixing of the individual fibrous components of the fibrous staple compound; and K. spinning the blended fibrous staple compound using a spinning frame for tightening thereof into sliver form of the fibrous staple compound;

L. tightening of the sliver form of the fibrous staple compound into a roving form of the fibrous staple compound;

M. placing of the roving form of the fibrous staple compound onto roving spools;

N. spinning of the roving form of the fibrous compound into yarn;

O. winding of the yarn onto cones while applying of a mixture of paraffin and ceramic wax thereon for lubrication thereof and to facilitate stabilizing thereof; and P. steam heating of the yarn to approximately 180 degrees Fahrenheit to cause melting of the nylon component thereof in order for enhancing stabilization of the yarn and to molecularly bond the ceramic material thereto for chemically retaining and further bonding together of the various fibers contained within the yarn.

* * * * *